United States Patent [19]

Akiyoshi et al.

[11] Patent Number: 4,675,507

[45] Date of Patent: Jun. 23, 1987

[54] HEAT COOKING APPARATUS HAVING A FLAT FLEXIBLE HEATER

[75] Inventors: Mitsuo Akiyoshi, Nara; Kazumi Hirai, Nabari; Yoshio Mitsumoto, Kashihara; Ichiroh Hori, Yamatokoriyama, all of Japan

[73] Assignee: Matsushita Electric Industrial Co., Ltd., Osaka, Japan

[21] Appl. No.: 853,220

[22] Filed: Apr. 17, 1986

[30] Foreign Application Priority Data

Apr. 17, 1985 [JP] Japan ..... 60-81666
May 14, 1985 [JP] Japan ..... 60-101851
Jul. 9, 1985 [JP] Japan ..... 60-150763

[51] Int. Cl.[4] ..... H05B 6/64

[52] U.S. Cl. ..... 219/406; 219/407; 219/10.55 B; 219/10.55 R; 126/275 E

[58] Field of Search ..... 219/10.55 B, 10.55 E, 219/10.55 R, 407, 406, 403; 126/19 R, 275 E

[56] References Cited

U.S. PATENT DOCUMENTS 1,874,836 8/1932 Trenner et al. ..... 219/407 X
3,155,814 11/1964 Appleman et al. ..... 219/407
3,161,755 12/1964 Tilus ..... 219/403
3,350,493 10/1967 Randall ..... 219/407 X
3,979,575 9/1976 Maahs ..... 219/407
4,137,442 1/1979 Tateda ..... 219/10.55 B

FOREIGN PATENT DOCUMENTS 54-133648 10/1979 Japan ..... 219/10.55 B

*Primary Examiner*—Philip H. Leung
*Attorney, Agent, or Firm*—Wenderoth, Lind & Ponack

[57] ABSTRACT

A heat cooking apparatus is provided with a heater comprising a plurality of metal, electric heating wires and a plurality of mica to insulate said wires, which is formed as a flat shape to provide on the outside of the heating chamber with substantially the same area as the ceiling of heating chamber, and which is firmly mounted onto said ceiling of the heating chamber by a heat resistant insulator and a metal keep plate.

5 Claims, 9 Drawing Figures

HEAT COOKING APPARATUS HAVING A FLAT FLEXIBLE HEATER

BACKGROUND OF THE INVENTION

The present invention relates to heat cooking apparatuses, and, more particularly, to a heat cooking apparatus such as an electric oven or a microwave oven with an electric heater wherein food in a heating chamber is heated by a heating device.

In a conventional electric oven or a microwave oven with an electric heater, heating devices have been adopted with a heating element shaped as a metal, commonly called a sheathed heater, or with a flat heating element sandwiched with flat insulation sheets, commonly called a flat heater. Flat heaters are roughly divided into two types; wall types and built-in types. A wall type flat heater is installed into an opening which is provided in the heating chamber wall, while a built-in type flat heater is installed within a predetermined space in the heating chamber, several examples of conventional heating devices being shown in FIGS. 1 through 4.

FIG. 1 is a cross-sectional view showing a conventional microwave heating range with build-in type sheathed heaters, and FIG. 2 is a perspective view showing the sheathed heater shown in FIG. 1. As shown in FIG. 1, the heating chamber 1 comprises an upper heater 2, a lower heater 3, and a pan 4 where food material 5 to be heated and cooked is placed. Furthermore, the apparatus is provided with a magnetron 6 which irradiates microwaves into the heating chamber 1 through a waveguide 7 to heat food 5. Thus, FIG. 1 shows a so-called compound-heating oven cooking range using electric heaters and microwaves, and the heater used in the heat cooking apparatus of FIG. 1 is shown in FIG. 2.

In this heat cooking apparatus of conventional construction, the upper heater 2 and lower heater 3 are exposed in the heating chamber 1, so that the effective capacity of the heating chamber 1 is reduced due to a reduction in volume of the heater. In order to contain large-sized food material, conventional heating chambers must be made larger, and, consequently, the external dimension of the conventional apparatus is proportionally larger requiring a larger space for it to be place, thus making it inconvenient to use. Moreover, heaters exposed in the heating chamber make it difficult to clean inside surfaces of the heating chamber soiled with scattered food material, making it even more inconvenient to use.

More specifically, the lower heater 3 is detachable so that the bottom face of the heating chamber can be easily cleaned when food material or soup drips on the face. However, to prevent microwave leakage, the joining part of the lower heater 3 to the heating chamber 1 is very complicated. The upper portion of the heating chamber 1 is easily stained and difficult to clean, even though the upper heater 2 is undetachable. Accordingly, this portion of the heating chamber is provided with a so-called self-cleaning layer which has a self-cleaning function to decompose adhered oil stains into water as well as carbon dioxide gas at temperatures higher than a predetermined temperature.

Even when this apparatus is used for grill cooking, where the upper heater reaches an allowable highest temperature, the temperature at the self-cleaning layer confronting the upper heater 2 scarcely reaches 300° C., so that the self-cleaning layer cannot perform total self-cleaning. In fact, this apparatus is commonly used in homes for oven cooking bread or cake, not for grill cooking food. When this apparatus is used for oven cooking, the large quantity of electric power supplied to the lower heater 3 at the bottom results in a lower temperature on the self-cleaning layer at the upper portion of heating chamber, supressing its self-cleaning potential. In addition, since the upper and lower heaters 2 and 3 are exposed in the heating chamber 1, the food material 5 directly receives radiation heat, especially from the upper heater 2, which locally burns the food in the pattern of the upper heater 2.

Although the lower heater 3 is the assembly or disassembly of it is troublesome. If the lower heater 3 is removed and washed with water, trouble may occur with its insulation or durability. Above of all, the exposure of heaters in the heating chamber 1 not only prevents easy cleaning, but is also unaesthetic.

FIG. 3 is a perspective view showing a conventional heat cooking apparatus with a wall type flat heater, wherein a part of the ceiling of the heater chamber is recessed to form an opening and a heater formed as a flat sheet is inserted and installed into the opening. In this construction, a significant thermal gradient is produced at the joining portions between the flat heater 8 and the ceiling of the heating chamber 1. That is, the temperature of the heater 8 rises quickly when energizing starts, and the heater 8 expands in a planar direction. The adjacent ceiling area of the heating chamber 1, however, remains at room temperature so that significant mechanical stress occurs at the joining portions between them. If this phenomenon is frequently repeated, a crack will appear at the joining portion which results in damage, and especially, in the case where microwave heating is jointly used, microwaves may leak or sparks may emit from said cracks. In this construction, it is difficult to provide a flat heater 8 over the entire ceiling area of the heating chamber 1, and, consequently, uneven heating by the heater cannot be totally eliminated.

Further, an example of a conventional heating apparatus, with a built-in type flat heater 8 provided in the heating chamber 1, is shown in FIG. 4. This construction possesses all the disadvantages common to the wall type flat heater 8 described above. In addition, the built-in flat heater 8 also prevents easy cleaning of the inside of the heating chamber, and significantly reduces the effective capacity of the heating chamber 1.

SUMMARY OF THE INVENTION

An object of the present invention is to eliminate the above described disadvantages and to provide a heat cooking apparatus wherein a heater is not exposed in a heating chamber, resulting in easy cleaning of the heating chamber, embellished shape, and larger heating chamber capacity; if the upper portion of the heating chamber is extensively oil-stained the apparatus can be used at its most suitable temperature for self-cleaning so that a self-cleaning layer can effect its total potential of securing reliability against heat and durability; and the apparatus can be used while securing high thermal efficiency, easy handling, trouble-free operation, and high reliability, yet its design is simple.

To attain the above described object, in a heat cooking apparatus according to the present invention, a heater comprising a plurality of metal, electric heating wires and mica to insulate said wires is formed into a flat shape and is provided outside the heating chamber and has substantially the same area as the ceiling of the heating chamber. The ceiling of the heating chamber is formed into a gentle convex slope extending toward the outside of the heating chamber, namely, toward the flat heater which is firmly joined to said ceiling of the heating chamber by a heat resistant insulator and a metal keep plate.

On said metal plate, a plurality of fine grooves are provided from the center towards the periphery so that the metal keep plate is attached to the ceiling of the heating chamber, thus permitting it to freely shrink in a planar direction. The metal plate and heater are attached to the ceiling of heating chamber by pressing the peripheral portion of the heater with springs or by tightening the same portion with screws and allowing only a very small clearance so that the flat heater and the ceiling of the heating chamber can uniformly and firmly contact each other.

In addition, a self-cleaning layer is provided on the inner surface of the heating chamber ceiling which contacts the flat heater. In the heat cooking apparatus of the present invention, the flat heater is provided outside of the ceiling of the heating chamber which is formed with a convex curvature towards the flat heater. Accordingly, with continuing heating, the heating chamber ceiling increases its curvature towards the flat heater because of the thermal expansion, and at the same time, the flat heater thermally expands.

However, the flat heater is fixed so as to expand in a planar direction, and, accordingly, contact pressure between the flat heater and the ceiling of the heating chamber increases so that heat from the flat heater can be uniformly and effectively transmitted towards the ceiling and food in the heating chamber.

The higher temperature of the flat heater and the ceiling of heating chamber is easily established, resulting in more uniform heat emission and less insulation degradation or less heating wire breakage. According to these operations, a heater provided outside the heating chamber can effectively heat food in the heating chamber and, moreover, heat can be more uniformly distributed by this construction, resulting in a more uniform heating of food in the heating chamber.

Since this construction does not require a heater exposed in the heating chamber, the effective capacity of the heating chamber can be increased and the inside surface of heating chamber can be easily cleaned, resulting in easy, convenient handling.

As described above, the flat heater is attached to the ceiling of the heating chamber so that it fits the convex curvature of the ceiling. At this time, the cut-grooves provided on the keep plate for the flat heater work effectively. That is, since the keep plate is provided with a flat sheet having a plurality of cut-grooves, when the convex curvature of the heating chamber ceiling becomes larger, the outer portion of the keep plate deforms in a wave-like shape in association with the convex curvature of the ceiling. The wave shape deformation of the keep plate prevents the heater from perfectly contacting the ceiling of the heating chamber causing ineffective heat transmission to the ceiling. Accordingly, the keep plate of the present invention is provided with a plurality of cut-grooves extending from the center to the outer periphery radially to permit them to absorb the deformation of the outer periphery so that the keep plate allows the flat heater to perfectly contact the ceiling of the heating chamber in any curvature, and heat from the flat heater is uniformly and effectively transmitted to the ceiling and to food in the heating chamber.

The flat heater according to the present invention can be attached to the ceiling by fixing it with flexible springs from the upper side or tightening screws which allow a little clearance, and thus, assembly is extremely simple, easy, and inexpensive.

Since the flat heater, the main heat source when electrically heating food, is provided outside the ceiling in contact with the ceiling, the self-cleaning layer, provided with substantially the same area as the inside of the ceiling, reaches 400°–450° C. at so-called grill heating or 300°–400° C. at so-called oven heating. These temperatures are approx. 100°–150° C. at grill heating and 100°–200° C. at oven heating higher than those in a conventional apparatus with upper and lower heaters. Consequently, the self-cleaning function is dramatically improved in this apparatus of the present invention.

In addition, since the color of said self-cleaning layer is black or dark gray, the self-cleaning layer has heat absorption and heat emission abilities similar to a blackbody so it effectively absorbs heat from the flat heater, heat source, and quickly emits the absorbed heat toward the heating chamber. This function eliminates overheating of the heating wires in the flat heater and the negative effects on the insulation mica, thereby contributing advantageously toward faster cooking and cooking quality.

When said self-cleaning layer repeats the expansion-shrinking cycle caused by heat from the flat heater, the effect of tensile stress on said self-cleaning layer which is mainly composed of glass is minimized, and compression stress is mainly applied to said self-cleaning layer by constituting a convex shape ceiling, at which said self-cleaning layer is provided.

Accordingly, a heating chamber provided with a self-cleaning layer which is extremely resistant to thermal stress can be manufactured by this constitution of the present invention. It can be easily imagined that this convex shaped heating chamber is best suited for a microwave heating chamber or a heat reflection chamber to effectively transmit microwave energy or heat energy toward food positioned at the center of the chamber.

Furthermore, since the flat heater can uniformly heat food, the food can be positioned at a point nearer to the heater. The self-cleaning layer is a blackbody, has excellent heat emission ability, and fully utilizes its self-cleaning function, and thus, the layer can keep itself clean even when the material is positioned near the layer.

As apparent from the preceding description, the heat cooking apparatus according to the present invention has advantages: of rapid heating, easy cleaning, beautiful constitution, high durability, and in that either microwave heating cooking or electrical heating cooking is possible.

BRIEF DESCRIPTION OF THE DRAWINGS

These and other objects and features of the present invention will become apparent from the following description taken in conjunction with a preferred embodiment thereof with reference to the accompanying drawings, in which.

DETAILED DESCRIPTION OF THE PREFERRED EMBODIMENTS

Figure 1:
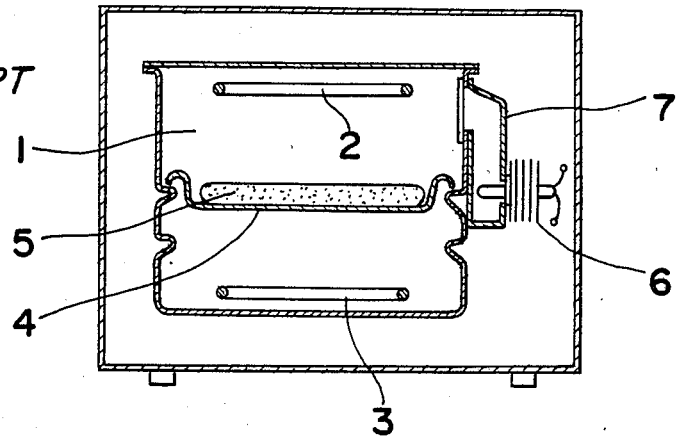
Fig. 1 PRIOR ART
FIG. 1 is a cross-sectional view showing a conventional microwave oven with a built-in type sheathed heater as already referred to above.
Figure 2:
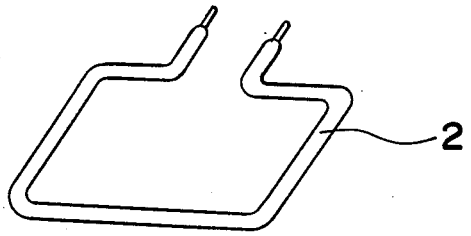
Fig. 2 PRIOR ART
FIG. 2 is a perspective view of the sheathed heater employed in the oven of FIG. 1.
Figure 3:
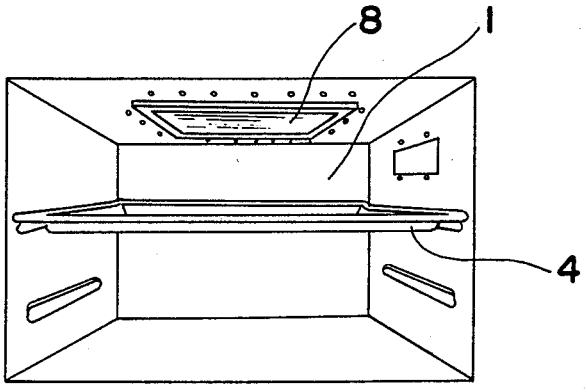
Fig. 3 PRIOR ART
FIG. 3 is a perspective view showing a conventional heat cooking apparatus with a wall type flat heater as already referred above.
Figure 4:
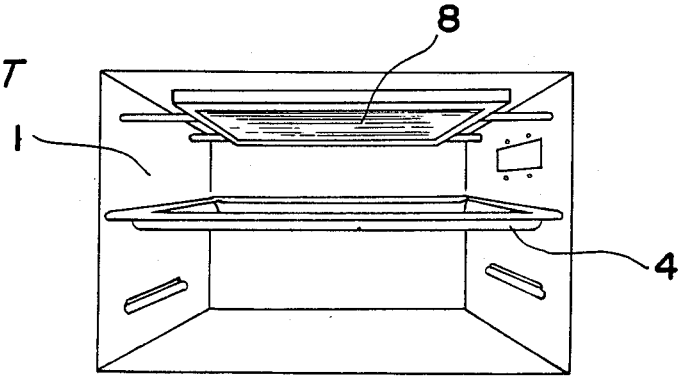
Fig. 4 PRIOR ART
FIG. 4 is a perspective view showing a conventional heat cooking apparatus with a built-in type flat heater as already referred above.

Before the description of the present invention proceeds, it is to be noted that like parts are designated by like reference numerals throughout the accompanying drawings.

Refering to FIGS. 5 to 8, one embodiment of the present invention will be described in detail hereinafter.

Figure 5:
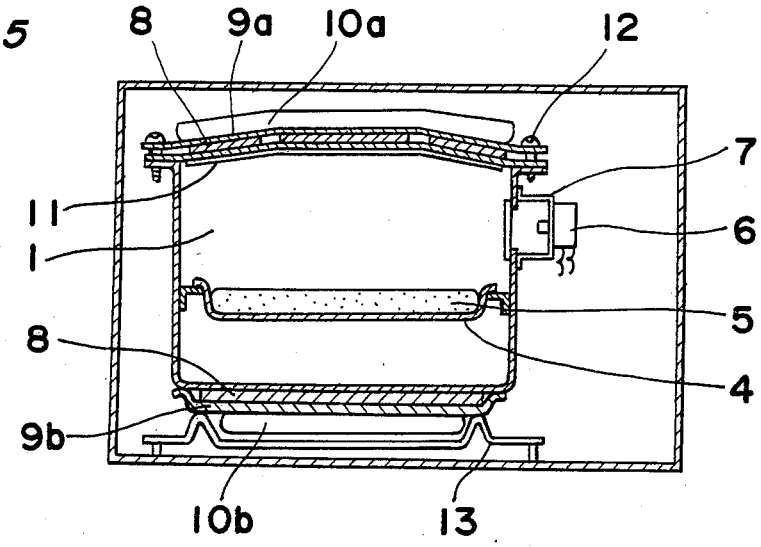
FIG. 5 is a cross-sectional view showing a heat cooking apparatus according to one preferred embodiment of the present invention.

In FIG. 5 a heat cooking apparatus according to the present invention includes, a pair of flat, planar heaters 8 provided outside the ceiling and base of the cubic heating chamber 1 having six walls perfectly contacting each other, respectively. Each of said flat heaters 8 is fixed to the ceiling or base of the heating chamber 1 by attaching metal plates 9. Heat insulating materials 10*a, b* are provided outwardly on the metal plate 9 so as to prevent heat emission toward the outside of the heating chamber 1.

A magnetron 6, provided on a waveguide 7, is adapted to heat food 5 positioned on a pan 4 by microwave heating. With the above described construction, food 5 can be heated be either electrical heating or microwave heating.

Since the flat heater 8 has substantially the same area as the ceiling of the heating chamber 1 having a small convex curvature, the food 5 can be positioned extremely close to the ceiling, by the pan and this construction can more effectively use the space that is conventionally occupied by the sheathed heater. Thus, the volume which can be effectively heated in a short time surrounding the pan 4, between the ceiling of the heating chamber 1 and the four wise walls of the heating chamber 1, is dramatically larger compared to the volume of a conventional apparatus.

Since the distance from food 5 placed on the pan 4 to the ceiling of the heating chamber 1 can be decreased, the temperature of the material will rapidly rise. Consequently, food is rapidly cooked without losing its delicious qualities.

The inner side of the ceiling of the heating chamber 1 is provided with a self-cleaning enamel layer 11, which provides good heat emission. That is, the temperature of the food rises rapidly, resulting in a large quantity of oil and water stains on the self-cleaning layer, and, the self-cleaning enamel layer reaches a temperature best suited for the self-cleaning function, so that all oil stains are eliminated from the layer. However, such a characteristic is not found in a conventional apparatus.

Figure 6:
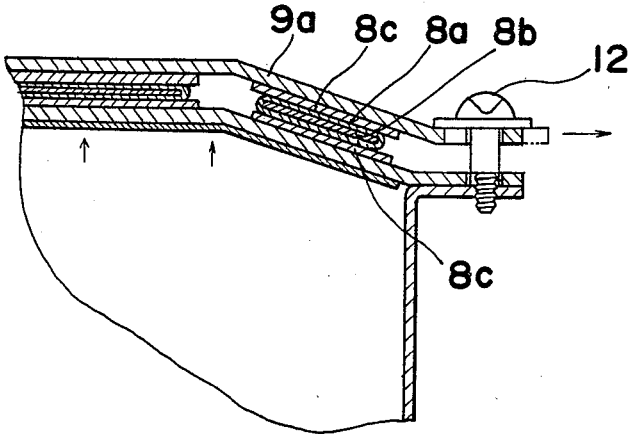
FIG. 6 is a cross-sectional view, on an enlarged scale, illustrating the detail of the flat heater shown in FIG. 5.
Figure 7:
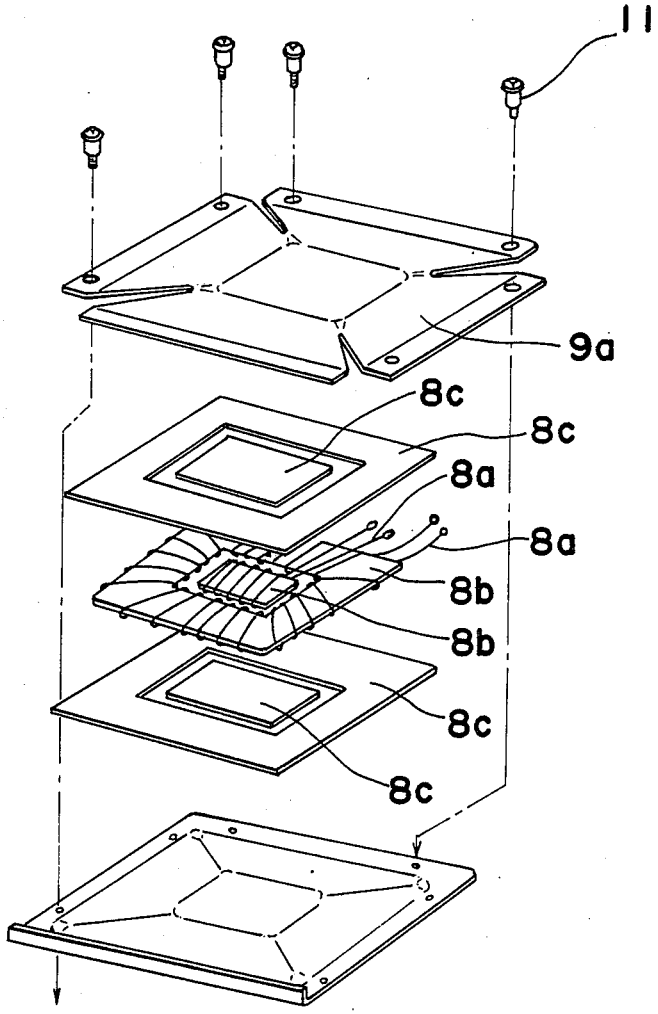
FIG. 7 is an exploded perspective view illustrating the flat heater shown in FIG. 5.

In FIGS. 6 and 7, the flat heater 8 comprises a heating element 8*a* wound around a winding base 8*b* made of a heat resistant and insulating material such as mica. Sandwiching this assembly are insulating plates 8*c* made of mica.

By this construction, the flat heater assembly 8 has a property of flexibility in the perpendicular direction to the surface of heating chamber 1 to facilitate an easy fit to the ceiling of the heating chamber 1.

Radially provided on an attaching plate 9*a* for the flat heater 8 are several slotted holes. A stepped screw 12 is inserted into the slotted hole to sandwich and tighten the flat heater 8 to the ceiling of the heating chamber 1. In this apparatus, the ceiling of the heating chamber 1 has a gentle convex curvature toward the flat heater 8.

With the above described construction, if and when the flat heaters 8 and attaching plate 9*a* deform by thermal expansion with the temperature rise in the apparatus, the attaching plate 9*a* can expand in a planar direction because the stepped screw 12 is loosely received in the slotted hole. However, the stress caused by heat expansion in the ceiling of the heating chamber 1 works in a perpendicular direction to the bend of the ceiling upwardly because the ceiling of the heating chamber 1 is restricted at its four sides. Accordingly, the contact between the flat heater 8 and the ceiling of the heating chamber 1 is tightened by this heat expansion. In addition, the flat heater 8 provided at the base of the heating chamber 1 is attached with a metal plate 9*b* for the same purpose. In this case, however, the metal plate 9*b* is fitted to the base with a bar shaped, flexible band 13 illustrated in FIG. 5 in order to facilitate an easy assembly operation. Furthermore, provided on the attaching plate for the upper flat heater 8*a* are cutouts extending along diagonal lines from the center toward the outer corners. With the above described construction, if and when the flat heater 8 and attaching plate 9*a* deform by thermal expansion with the temperature rise in the apparatus, the attaching plate for the upper flat heater 9*a* is expanded in the same manner as mentioned above to push up to contact the ceiling of the heating chamber 1 closely reducing the clearance of said cutouts.

Figure 8:
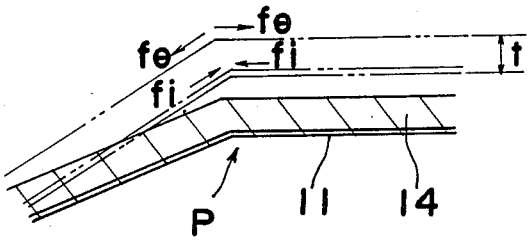
FIGS. 8(*a*) and 8(*b*) are explanatory views showing stress conditions caused by thermal expansion at the heating chamber ceiling.
Figure 8:
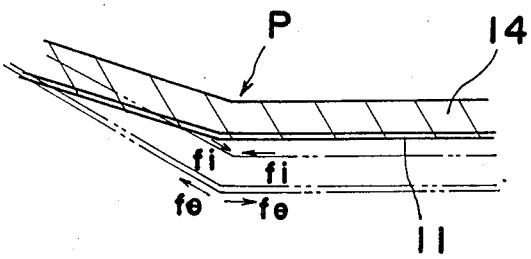

As illustrated in FIGS. 8(*a*) and 8(*b*) the heating chamber ceiling 14 is constituted to have a gentle convex curvature toward the outside of the heating chamber. When the heating chamber ceiling expands by heat from the heater (not shown in the figure), the ceiling deforms as shown in FIG. 8(*a*) because the four sides of the ceiling are fixed and it cannot expand toward the walls of the heating chamber. In this case, forces shown in FIG. 8(*a*) are applied to the point P on the ceiling, that is, a compression force f1 is applied to the inner face, and a tensile force f$\theta$ is applied to the outer face of the ceiling 14 having a thickness t. On the contrary, if the ceiling has a curvature extending toward the inside of the heating chamber as shown in FIG. 8(*b*), tensile force f$\theta$ is applied to the inner face of the heating chamber with the enamel layer, and compression force f1 is applied to the outer face of the heating chamber. An apparatus according to the present invention is provided with a self-cleaning enamel layer 11 at the ceiling of the heating chamber. The enamel layer is mainly composed of glass and inorganic materials and the layer resists compression force, but is extremely weak against tensile force.

It has been clearly demonstrated by experimental trial that these characteristics are especially true of a self-cleaning layer equal to or thicker than 300 micron meters. That is, continuous and intermittent blank baking tests were carried out, simulating grill cooking, using an apparatus with the heating chamber ceiling 14 made from an aluminized steel sheet formed an aluminum porcelain enamelling layer. As a result, all heating chamber ceilings 14 shaped as shown in FIG. 8(*b*) having thicknesses of 1; 0.6, 2; 0.8 and 3; 1.0 mm cracked on their enamel layers within 80–120 hours. On the contrary, the heating chamber ceiling 14 shaped as shown in FIG. 8(*a*) has never cracked on its enamel layer after 500 hours. Accordingly, the theory on which the present invention is based has been proved to be true by these experimental trials.

As is clear from the preceding description, the following advantages can be attained by the heat cooking apparatus according to the present invention.

(1) The heat cooking apparatus according to the present invention is provided with electrical heaters in a flat shape. When the flat heater is provided above the heating chamber, a self-cleaning layer on the heating chamber ceiling inside reaches 300°–450° C. where the catalytic action of the self-cleaning layer works effectively, during the actual cooking operation. Moreover, by adopting a flat heater, food positioned in the heating chamber can be heated more uniformly. Accordingly, even when food to be heated is positioned nearer to the heating chamber ceiling heat source, the ceiling which is hardly cleaned in a conventional apparatus can be kept clean, and the effective capacity of the heating chamber is enlarged. This is a main characteristics of the flat heater of the present invention, and in this construction, there is no protrusion in the heating chamber which can be kept clean both actually and visually.

(2) By designing the ceiling of heating chamber to have a convex curvature toward the flat heater, the ceiling can contact the flat heater perfectly during heating so that heat from the flat heater can be effectively transmitted toward the heating chamber to increase total heat efficiency.

(3) Local and uneven heating characteristics can be eliminated to improve the cooking quality.

(4) Local overheating of the heater can be eliminated which reduces wire damage or insulation degradation in heating elements.

(5) The heater can be disposed outside the heating chamber with high heating efficiency, and thus, there is no protrusion in the heating chamber, thereby facilitating cleaning and handling of the heat cooking apparatus.

(6) The walls of the heating chamber always deform in one direction during heating, thus permitting an apparatus design with stable and uniform heat distribution during microwave heating, and reduction in uneven heating of food by microwave heating.

(7) A keep plate for the flat heater is slidably attached to the heating chamber to eliminate the wave shape deformation on the outer periphery so that the flat heater can contact perfectly with the ceiling of the heating chamber at any heating stage to effectively transmit heat from the flat heater toward food material, increasing the total heat efficiency.

(8) A self-cleaning function layer such as a self-cleaning enamel layer provided on the ceiling of heating chamber is black or dark grey so that it works as a so-called blackbody to have superior heat absorption and heat emission characteristics. Accordingly, the layer can absorb and transmit high temperature heat from the flat mica heater, which has superior insulation ability, toward food material positioned in the heating chamber.

(9) The ceiling of the heating chamber provided with a self-cleaning layer has a convex curvature toward the outside. When the ceiling expands due to heat from the electrical heater or microwave, a compression stress is mainly aplied to said self-cleaning layer to prevent it from cracking or flaking, so that the temperature of the self-cleaning layer can be increased up to the maximum allowable point. Accordingly, by displaying a self-cleaning layer on the upper part of the heating chamber, a heating chamber with an efficient grill cooking function, stable self-cleaning ability, and long service life can be manufactured.

Therefore, according to the present invention, an electric heating apparatus is provided that is simple in construction, is highly reliable, durable, and safe, has uniform and rapid heating capabilities, enlarged effective capacity, and facilitates cleaning of the heating chamber, wherein those characteristics are the superior features of a flat heater.

Although the present invention has fully been described in connection with the preferred embodiment thereof, it is to be noted that various changes and modifications are apparent to those skilled in the art. Accordingly, such changes and modifications are to be understood as included within the scope of the present invention as defined by the appended claims, unless they depart therefrom.

What is claimed is:

1. A heat cooking apparatus comprising:

a heating chamber including a ceiling and a base, at least one of said ceiling and said base being convex in a direction outward from said heating chamber;

a flexible heater for radiating heat covering a substantial portion of said at least one of said ceiling and said base, said heater comprising a flexible flat plate conforming to the convex surface of said at least one of said ceiling and said plate, said flat plate of said heater contacting and slidable relative to the convex surface of said at least one of said ceiling and said base that is outside said heating chamber such that when said flat plate of said heater thermally expands and contracts said plate slides on said convex surface; and attaching means for resiliently urging said flat plate against said convex surface such that when said flat plate thermally expands and contracts said flat plate is urged by said attaching means to maintain contact with said convex surface.

2. A heat cooking apparatus as claimed in claim 1, wherein said attaching means comprises flexible, bar shaped springs.

3. A heat cooking apparatus as claimed in claim 1, wherein said attaching means comprises an attachment plate having a plurality of slots therethrough adjacent the periphery thereof, said slots extending in a direction toward said periphery of said attachment plate, and a respective screw extending through each of said slots for loosely securing said attachment plate to said at least one of said ceiling and said base for permitting said attachment plate to move relative to said at least one of said ceiling and said base when said heater thermally expands and contracts.

4. A heat cooking apparatus as claimed in claim 1, wherein said attaching means comprises a metal keep plate, and fastening means for loosely securing said metal keep plate to said at least one of said ceiling and said base, said metal keep plate having at least one groove extending therethrough between a central portion thereof and a peripheral edge therefrom for facilitating flexing of the metal plate when said heater thermally expands and contracts.

5. A heat cooking apparatus as claimed in claim 1, and further comprising a self-cleaning layer on the surface of said at least one of said ceiling and said base that is inside said heating chamber.

* * * * *